US012157598B2

(12) United States Patent
Baumeister

(10) Patent No.: US 12,157,598 B2
(45) Date of Patent: Dec. 3, 2024

(54) VERTICAL-FLOW WRAPPER AND METHOD TO PRODUCE A BAG

(71) Applicant: GEA Food Solutions Weert B.V., RV Weert (NL)

(72) Inventor: Bruno Gerfried Baumeister, Aachen (DE)

(73) Assignee: GEA FOOD SOLUTIONS WEERT B.V., Rv Weert (NL)

( * ) Notice: Subject to any disclaimer, the term of this patent is extended or adjusted under 35 U.S.C. 154(b) by 285 days.

(21) Appl. No.: 17/762,160

(22) PCT Filed: Sep. 29, 2020

(86) PCT No.: PCT/EP2020/077172
§ 371 (c)(1),
(2) Date: Mar. 21, 2022

(87) PCT Pub. No.: WO2021/063913
PCT Pub. Date: Apr. 8, 2021

(65) Prior Publication Data

US 2022/0371757 A1 Nov. 24, 2022

(30) Foreign Application Priority Data

Sep. 30, 2019 (EP) ..... 19200515
Feb. 27, 2020 (EP) ..... 20159691

(51) Int. Cl.
*B65B 9/00* (2006.01)
*B65B 9/20* (2012.01)
(Continued)

(52) U.S. Cl.
CPC ..... *B65B 9/2028* (2013.01); *B65B 51/30* (2013.01); *B65B 61/16* (2013.01); *B65B 61/188* (2013.01)

(58) Field of Classification Search
CPC ..... B29C 65/02; B29C 66/4312; B65B 9/20; B65B 9/2028; B65B 51/30
See application file for complete search history.

(56) References Cited

U.S. PATENT DOCUMENTS 4,727,709 A * 3/1988 Zieke ..... B65B 9/13 53/551
4,745,731 A * 5/1988 Talbott ..... B65B 61/28 53/551
(Continued)

FOREIGN PATENT DOCUMENTS

CN 203063111 U 7/2013
DE 202018104342 U1 10/2018
EP 1106515 A1 * 6/2001 ..... B29C 66/1122

OTHER PUBLICATIONS

International Search Report and Written Opinion, dated Dec. 18, 2020, for International Application PCT/EP2020/077172.
(Continued)

*Primary Examiner* — Eyamindae C Jallow
(74) *Attorney, Agent, or Firm* — The Dobrusin Law Firm, P.C.

(57) ABSTRACT

A vertical flow-wrapper that includes a form-fill-tube along which a film is transported in a transport direction and formed into a film tube; a longitudinal-sealing means, which seals two opposing longitudinal ends of the film tube together to form a longitudinal seal, the longitudinal-sealing means includes a seal jaw and a pair of guiding rollers provided upstream from the seal jaw to guide the two opposing longitudinal ends of the film tube through the seal jaw and pressing means to press the two opposing longitudinal ends of the film tube together; and a cross-sealing means and a cutting means which provide cross seals to each package and separate the packages from each other; an axis of rotation of the pair of guiding rollers are provided parallel
(Continued)

to a transportation plane of the two opposing longitudinal ends of the formed film and not perpendicular to the transport direction.

16 Claims, 9 Drawing Sheets

(51) Int. Cl.
*B65B 51/30* (2006.01)
*B65B 61/16* (2006.01)
*B65B 61/18* (2006.01)

(56) References Cited

U.S. PATENT DOCUMENTS 4,829,745 A * 5/1989 Behr ..... B65B 9/2035 53/551
4,894,975 A * 1/1990 Ausnit ..... B29C 66/7392 53/139.2
4,974,395 A * 12/1990 McMahon ..... B65B 61/188 53/374.6
5,014,497 A * 5/1991 McMahon ..... B65B 9/20 493/193
5,072,571 A * 12/1991 Boeckmann ..... B65B 51/303 53/553
5,400,565 A * 3/1995 Terminella ..... B65B 61/188 53/139.2
5,505,037 A * 4/1996 Terminella ..... B65B 61/188 53/139.2
5,574,427 A 11/1996 Cavallaro
5,746,043 A * 5/1998 Terminella ..... B29C 66/8222 53/551
5,768,852 A * 6/1998 Terminella ..... B65B 61/188 53/139.2
5,930,983 A * 8/1999 Terminella ..... B65B 61/188 53/436
6,047,521 A * 4/2000 Terminella ..... B65B 9/213 53/139.2
6,553,744 B1 * 4/2003 Terminella ..... B65B 9/2042 53/551
2018/0033427 A1 2/2018 Kwon
2020/0276768 A1 * 9/2020 Lank ..... B29C 66/8161

OTHER PUBLICATIONS

Chinese Office Action Dated Feb. 19, 2023, for Chinese Patent Application No. 202080068760.X.

* cited by examiner

VERTICAL-FLOW WRAPPER AND METHOD TO PRODUCE A BAG

FIELD

The invention relates to improvements of a vertical flow-wrapper, for producing tubular bags from a film web with re-closure means and the corresponding bag. The invention further relates to a method to produce a bag.

PRIORITY

This application is a US National Stage entry of International Application No. PCT/EP2020/077172 filed on Sep. 29, 2020, which claims priority to EP 19200515.5 filed on Sep. 30, 2019 and to EP 20159691.3 filed on Feb. 27, 2020.

BACKGROUND

A common method of making bags out of a film web is the use of a vertical flow-wrapper, as for example disclosed in US 2018/033427 A1 or in DE 20 2018 104 342 U1. Such a packaging machine receives a continuous flat sheet, a film of plastic material, e.g. a thermoplastic material, which is transported continuously or intermittently and passed downwardly over a form shoulder and is then shaped into a tubular form, i.e. into a film/film tube, by being wrapped around a vertical form-fill tube of the packaging machine. After being wrapped around the vertical form-fill tube, the film web is longitudinally closed by means of a longitudinally extending seal which is applied to the film especially by heat sealing the lateral/longitudinal margins of the film web or by heat sealing in the vicinity of these margins thereby joining them. This is carried out by so called longitudinal-sealing means. The film tube has conventionally a rectangular, elliptical, circular or other shaped cross-sectional area. Conventionally, the film tube is closed by cross-sealing means, preferably in a direction perpendicular to the direction of flow, i.e. transversely. Thereby, individual bags are defined out of the continuous film tube. A product, such as a foodstuff, is introduced by dropping the product through a form-fill tube and into the film tube surrounding the form-fill-tube. During filling, the film tube is transversely open at its upper end, i.e. not cross-sealed. Thereafter and/or simultaneously, the film tube together with the product is moved downwardly and then a top cross-seal is formed above the product and thereby a hermetically closed bag produced. As a last step or simultaneously to the application of the top seal, the bag is separated from the film tube by cutting means. According to the present invention, the vertical flow wrapper comprises means to apply re-closure means to each package, arranged parallel to the longitudinal seal. With these re-closure means, the bag can be reclosed after it has been opened by removing and/or opening the longitudinal seal. The re-closure means are normally applied to the film prior to providing the longitudinal seal.

SUMMARY

The purpose of the present invention is to improve the vertical flow-wrapper and/or the resulting bag.

The purpose is attained by providing a vertical flow-wrapper with:

- a form-fill-tube along which a film is transported in a transport direction and formed into a tube,

- a longitudinal-sealing means, which seals two opposing longitudinal ends of the formed film together to a longitudinal seal, comprising a seal jaw and a pair of guiding rollers provided upstream from seal jaw to guide the two opposing ends of the formed film through the seal jaw and pressing means to press the two opposing ends of the formed film together to form the longitudinal seal,
- a cross-sealing means and a cutting means which provide cross seals to each package and separate the packages from each other and
- wherein the axis of rotation of the guiding rollers are provided parallel to the transportation plane of the two opposing ends of the formed film and not perpendicular to the transport direction.

The disclosure regarding this embodiment of the present invention also applies to the other embodiments of the present invention. Subject matters from one embodiment can be incorporated into other embodiments and vice versa.

The present invention relates to a vertical flow-wrapper with a frame and/or a housing. A continuous plane sheet, a film of plastic material, e.g. a thermoplastic material is transported continuously or intermittently and passed over a form shoulder and thereby shaped into a tubular form, i.e. into a film tube and then wrapped around a vertical form-fill tube of the packaging machine. After being wrapped around the vertical form-fill tube, the film web is longitudinally closed by means of a longitudinally extending seal which is applied to the film especially by sealing, preferably heat sealing, the lateral/longitudinal margins of the film web or by sealing in the vicinity of these margins thereby joining them. This is carried out by so called longitudinal-sealing means. The film tube has conventionally a rectangular, elliptical, circular or other shaped cross-sectional area. Conventionally, the film tube is closed by cross-sealing means, preferably in a direction perpendicular to the direction of flow, i.e. transversely. Thereby, individual bags are defined out of the continuous film tube. A product, such as a foodstuff, is introduced into the film tube by dropping the product through a form-fill tube and into the film tube surrounding the form-fill tube. During filling the film tube is transversely open at its upper end, i.e. not cross-sealed. Thereafter and/or simultaneously, the film tube together with its product is moved downwardly and then a top cross-seal is provided above the product and thereby the hermetically closed bag is completed. As a last step or simultaneously to the application of the top cross-seal, the bag is separated from the film tube by cutting means.

The longitudinal sealing means comprises a seal jaw which heats the film. A pair of guiding rollers are provided, relative to the transport direction of the film-tube, upstream from seal jaw to guide the two opposing ends of the formed film, which are sealed together, through the seal jaw. Pressing means to press the two opposing ends of the formed film together to form the longitudinal seal are provided, relative to the transport direction of the film-tube, downstream from the seal jaw.

The film passes though the pair of guiding rollers. One roller is preferably provided on each side of the film.

Preferably, one of the two rollers is driven, preferably with a motor. The roughness of the surface of the rollers, particularly the driven roller, is preferably such, that the roller(s) can slip relative to the film.

According to the present invention, the axis of rotation of the guiding rollers are provided parallel to the transportation plane of the two opposing ends of the formed film and not perpendicular to the transport direction.

Preferably, the angle under which the axis of rotation is provided is adjustable, preferably automatically. Preferably, the normal force applied to the film by the two rollers can be adjusted, preferably automatically.

According to another or a preferred embodiment of the present invention, the guiding rollers stretch the film in a transversal direction.

The disclosure regarding this embodiment of the present invention also applies to the other embodiments of the present invention. Subject matters from one embodiment can be incorporated into other embodiments and vice versa.

Preferably, the degree of stretching can be adjusted, preferably by changing the angle under which the axis of rotation of the guiding rollers are provided and/or by changing the normal force applied to the film by the two rollers.

Preferably, the pair or rollers that does the stretching comprises one cylindrical roller and one roller with a convex surface.

The following applies to all embodiments of the present invention.

According to a preferred embodiment of the present invention, the vertical flow wrapper comprises means to apply re-closure means to each package, arranged parallel to the longitudinal seal. With these re-closure means, the bag can be reclosed after it has been opened by removing and/or opening the longitudinal seal. The re-closure means are preferably applied to the film at least partially simultaneously to providing the longitudinal seal.

The re-closure means preferably comprise closing means, such as a male and a female part or such as tongue and groove which are preferably provided as two parts, respectively. Each part of the closing means preferably comprises a flange, which is attached to the film. The re-closing means is preferably a zipper.

The reclosing means sealing means preferably comprises a pressing means and/or a seal jaw. The pressing means is preferably two pairs of rollers, each pair provided on one axis.

Two rollers are preferably provided on each side of the film. The two pairs of rollers are preferably provided at a distance to each other, which is large enough to accommodate the middle part of the reclosing means.

Preferably, the re-closing means sealing means do not comprise means to guide the re-closing means, preferably the zipper.

According to a preferred embodiment of the present invention, the longitudinal-sealing means comprises pressing means, preferably a pair of rollers. One roller is preferably provided on each side of the film.

Preferably, the pressing force applied to the film applied by pressing means of the longitudinal sealing means and the pressing means of the re-closure sealing means are adjustable independently from each other.

According to another preferred or inventive embodiment of the present invention, the vertical flow-wrapper comprises downstream from the longitudinal- and/or re-closing means sealing means a pair of rollers whose axis of rotation are provided parallel to the transportation plane of the two opposing ends of the formed film and not perpendicular to the transport direction.

The disclosure regarding this embodiment of the present invention also applies to the other embodiments of the present invention. Subject matters from one embodiment can be incorporated into other embodiments and vice versa.

The film passes though the pair of rollers. One roller is preferably provided on each side of the film. The rollers stretch the film prior to providing the cross seal.

Preferably, one or both of the two rollers are driven, preferably with a motor. The roughness of the surface of the rollers, particularly the driven roller, is preferably such, that the film can slip relative to the rollers.

Preferably, the degree of stretching can be adjusted, preferably by changing the angle under which the axis of rotation of the guiding rollers are provided and/or by changing the normal force applied to the film by the two rollers.

The gap between the jaws are preferably individually adjustable for the longitudinal seal and for the re-closing means sealing means.

Preferably, the heated parts of each sealing jaw are preferably supported close to the film.

The problem is also solved with a method to produce a re-closable bag comprising the following steps:

forming a plane film into a tube,
applying a longitudinal seal,
applying a lower cross seal,
filling the bag with a packaging item,
applying an upper cross seal, wherein, the film is guided by two rollers whose axis of rotation are provided parallel to the transportation plane of the two opposing ends of the formed film and not perpendicular to the transport direction.

The disclosure regarding this embodiment of the present invention also applies to the other embodiments of the present invention. Subject matters from one embodiment can be incorporated into other embodiments and vice versa.

Another preferred or inventive subject matter of the present invention is a method wherein prior and/or after the application of the longitudinal seal the two longitudinally sealed ends of the film are stretched in a direction perpendicular to transport direction of the film, preferably by two rollers whose axis of rotation are provided parallel to the transportation plane of the two sealed ends of the formed film and not perpendicular to the transport direction.

According to this embodiment of the present invention, a slip of the film relative to the stretching means downstream from the longitudinal sealing means is desired. This can, for example, be accomplished by a pair of rollers, whose axis of rotation is not perpendicular to the transport direction of the film. The slip and/or stretch can increased or decreased by changing this angle and/or by changing the normal force on the film provided by the pair of rollers.

Preferably, prior and/or after the application of the longitudinal seal the ends of the film are stretched in a direction perpendicular to transport direction of the film.

The invention is disclosed referring to the figures of the attached drawings, by way of non-limiting examples. The disclosure applies to all embodiment of the present invention likewise.

DETAILED DESCRIPTION

Figure 1:
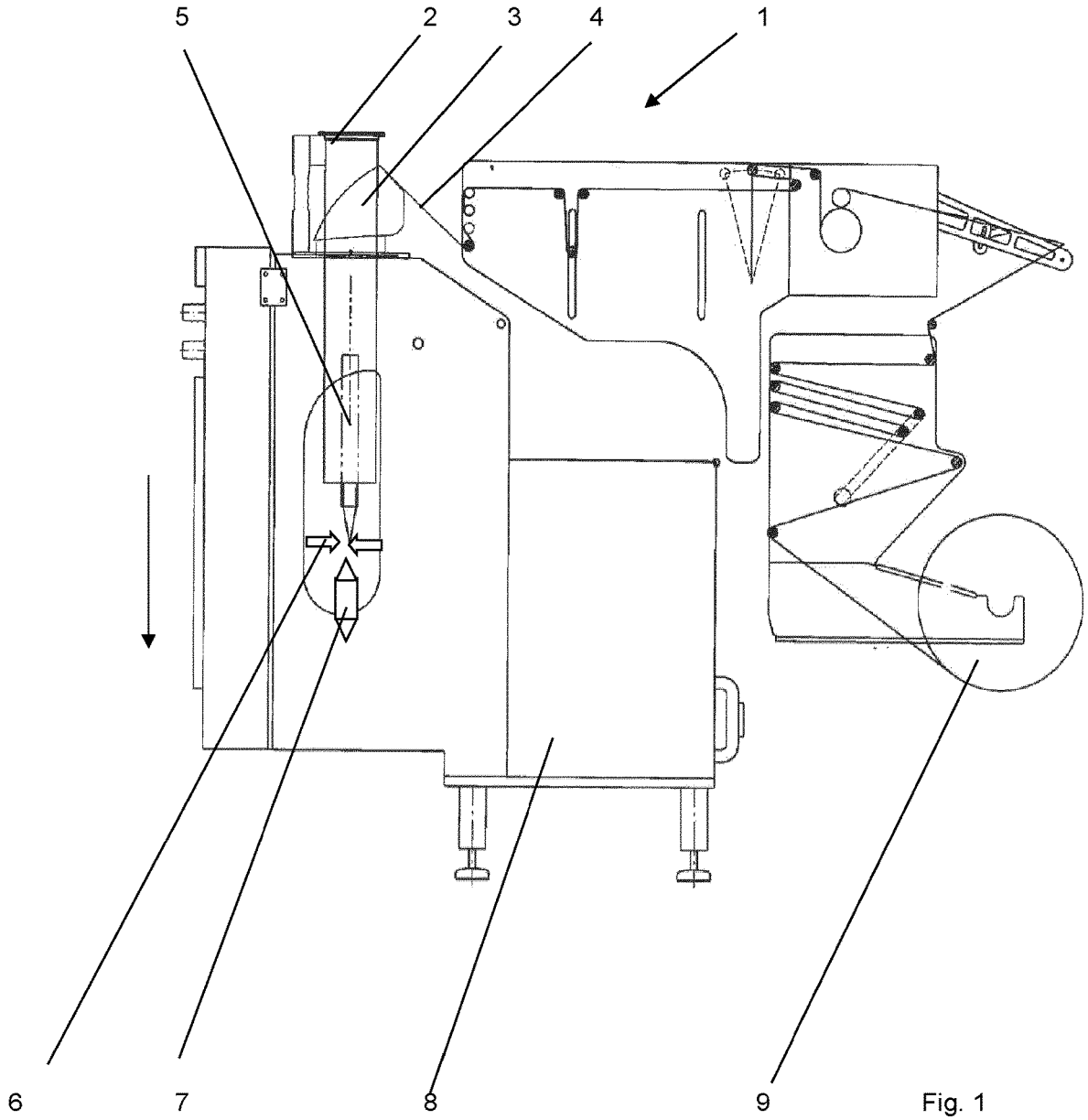
FIG. 1 shows schematically the vertical flow-wrapper according to the invention.

In FIG. 1, the vertical flow-wrapper 1 according to the invention is schematically shown and according to FIG. 1, the inventive method is described. A vertical flow wrapper is a packaging machine, which forms a plane film/film (in the following film) web into a film tube, which is transported continuously or intermittently along a form-fill tube 2. Two ends of this film tube are sealed together by a longitudinal sealing means 5. Subsequently, the packaging item is filled into the film tube and a cross-seal 10 is applied to the film tube to close the package. Simultaneously or after applying the cross-seal, the finalized packages are cut off the film tube. The vertical flow wrapper comprises a frame/housing 8, at which a form shoulder 3, a form-fill tube 4, and longitudinal sealing means 5 and cross-sealing means 6 are provided. Furthermore, the inventive vertical flow wrapper can comprise means to attach re-closure means for every bag, for example a zipper, to the film, the re-closure means for each bag are provided parallel to the transport direction of the film and/or parallel to the longitudinal seal 11. The attachment, for example sealing, of the re-closure means to the film is preferably provided at least partially simultaneously to the provision of the longitudinal sealing. The vertical flow-wrapper may comprise gusset-forming means to form the bottom and/or the top of each bag.

A web of a film 4, especially a weldable plastic film 4, is supplied from a reel, which supplies the plane film continuously or intermittently to a form shoulder 3, which shapes the film web into a rather tubular form around a form-fill tube 2. In the context of the present invention, a "tubular form" of the bags or of the film means any cross-sectional form including a circular form or another form, and especially a rectangular or generally a polygonal form.

Longitudinal sealing means 5, which are provided downstream from the form shoulder, seal the edges to the film tube together. After sealing, the bottom of the bag 7 can be formed by a special bottom forming means, for example gusset-forming means. Finally, cross seals, extending preferably perpendicularly to the direction of flow of the film, are applied, especially by means of cross-sealing means 6. These cross sealing means 6 apply to the bag 7 not only a cross-seal closing the top of the bag 2, but these cross-sealing means 6 advantageously also provide, preferably simultaneously a cross-seal defining the bottom of the subsequent, upstream bag 2. The bags 2 produced are separated from one another by a cutting means, which are preferably incorporated into the cross-sealing means 6. Between the application of the bottom- and top-cross-seal of each bag, the bag is filled with the product, preferably an edible product. Parallel, at least partially regarding time and in terms of direction to the longitudinal seal, re-closure means for every bag, for example a zipper, is attached to the film. The vertical flow-wrapper may comprise gusset-forming means to form the bottom and/or the top of each bag.

Figure 2:
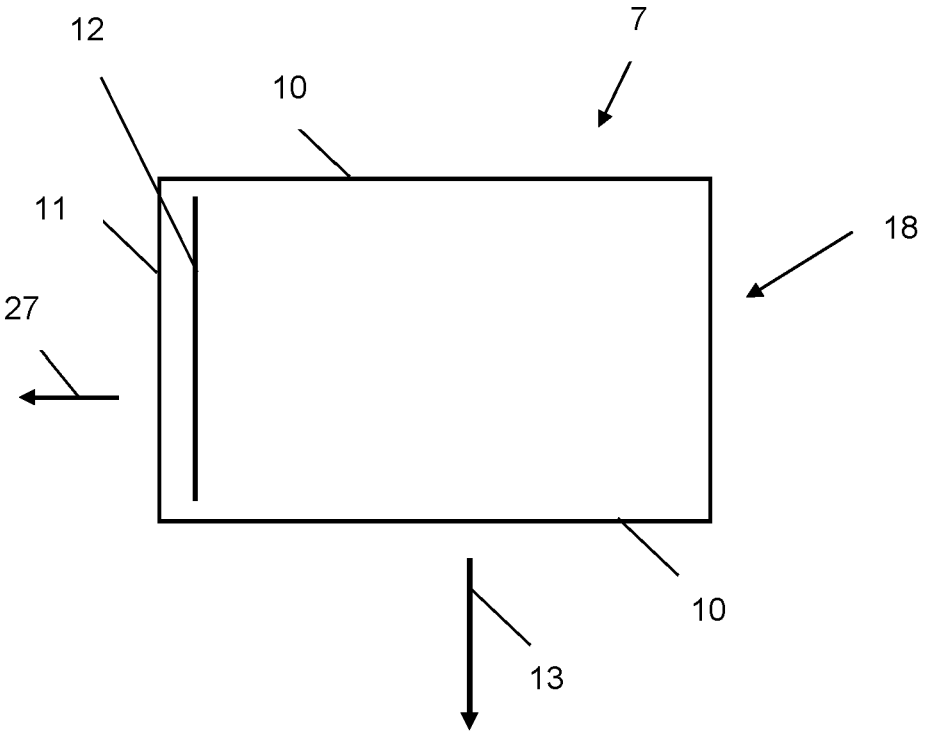
FIG. 2 shows details of a bag that can be produced with the inventive vertical flow-wrapper or the inventive method.

FIG. 2 shows an example of a bag 7, which can be produced by the inventive flow-wrapper and/or according to the inventive method. Arrow 13 depicts the transport direction of the film. The inventive bag 7 comprises two cross seals 10, which are provided transversely to the transport direction 13 of the film. Parallel to the transport direction of the film and at the opposite end of the bottom 18 of the bag 7, a longitudinal seal 11 is provided. Adjacent to the longitudinal seal, a re-closure means 12, here a zipper, is provided, which allows to re-close the bag after the longitudinal seal has been removed and/or opened. The bag 7 may comprise a gusset at its bottom 18.

Figure 3:
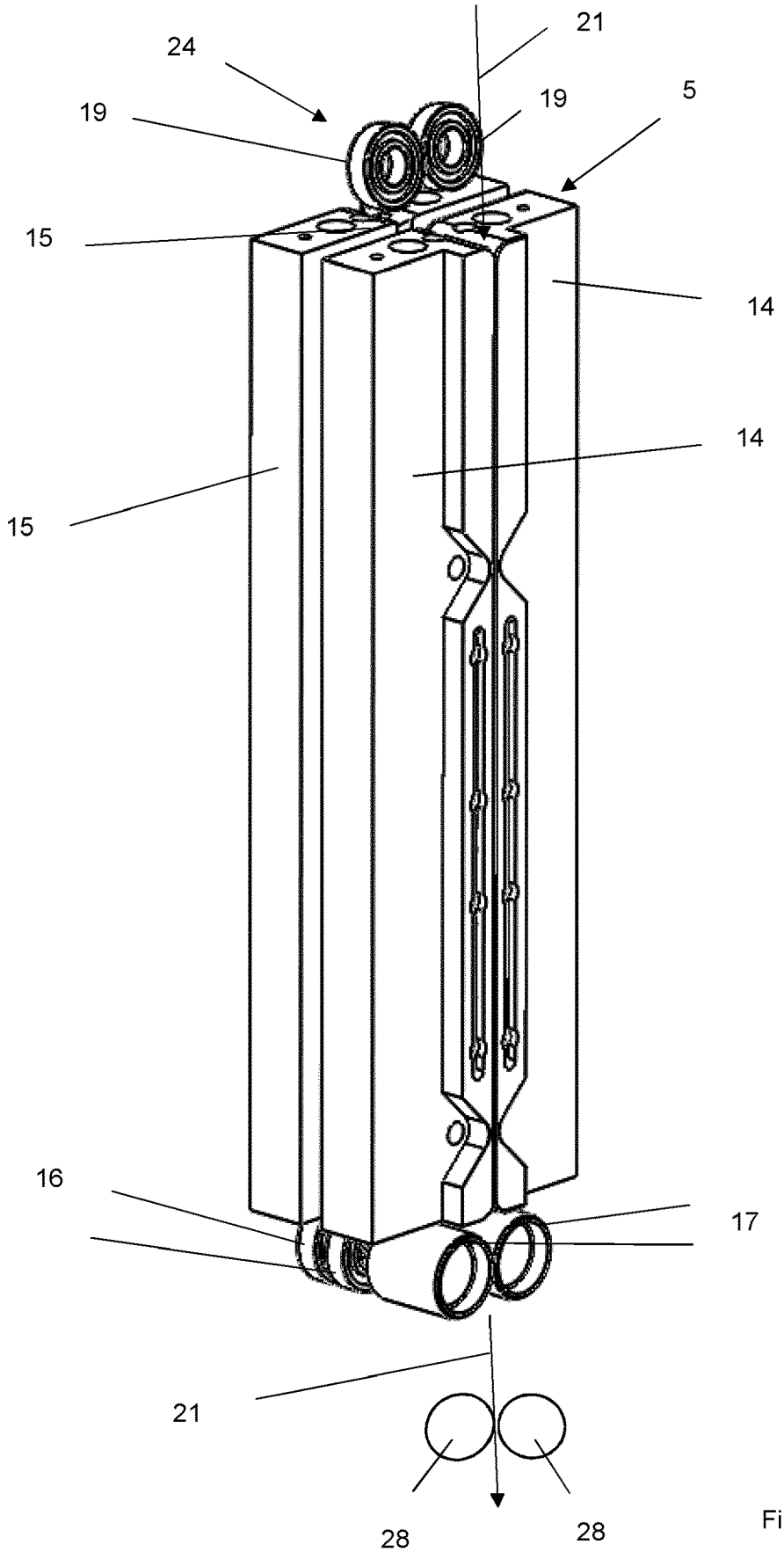
FIGS. 3-5 show details of the sealing means.
Figure 4:
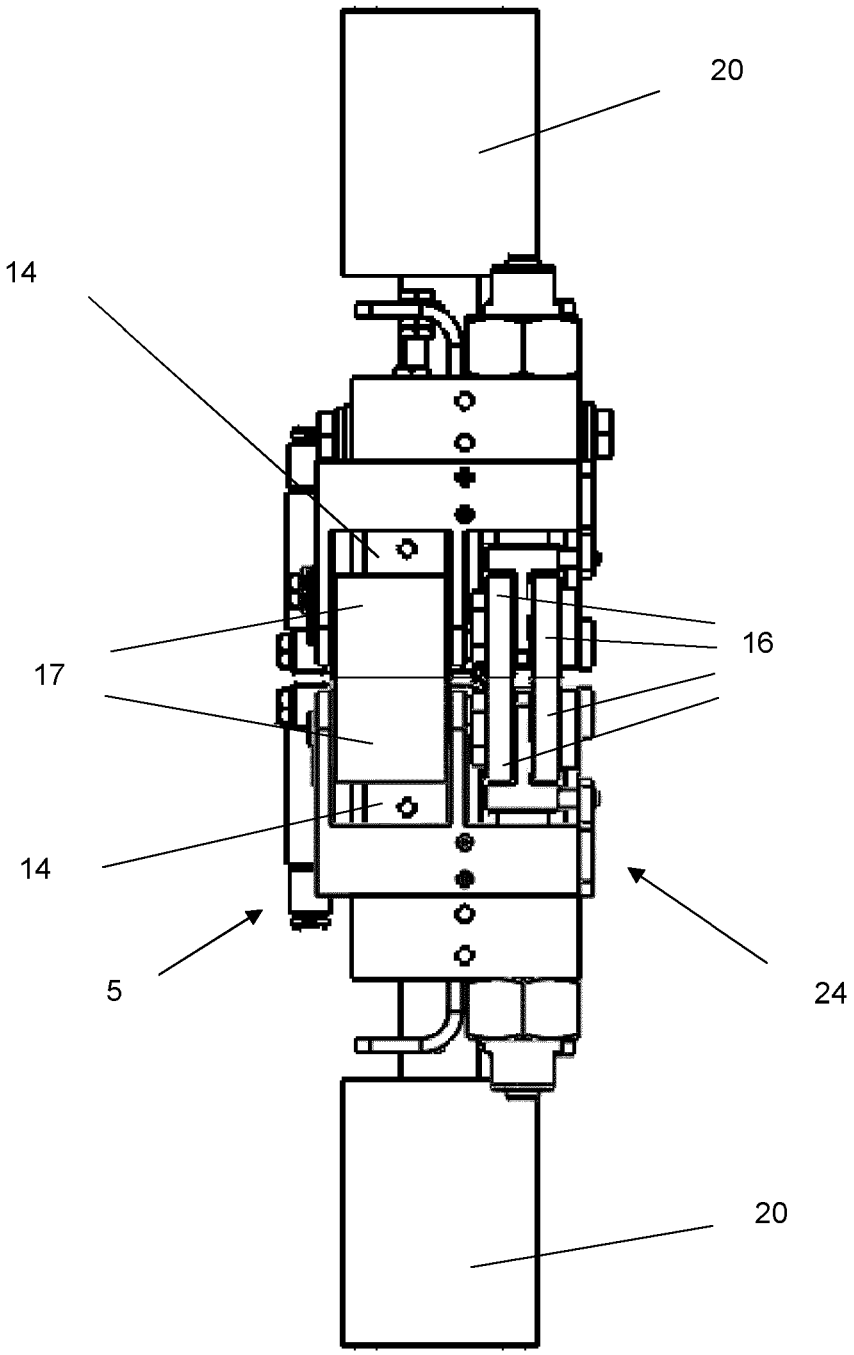
Figure 5:
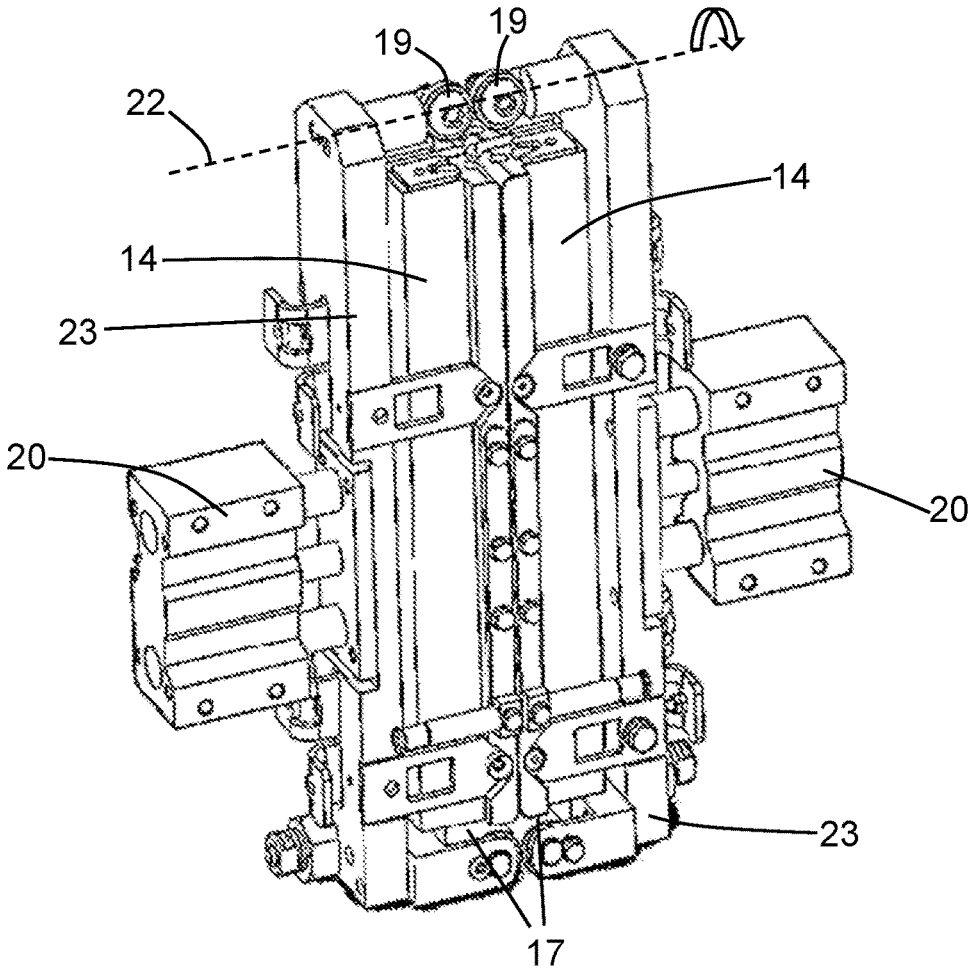

FIGS. 3-5 show details of the sealing means 5 which provide the longitudinal seal and sealing means 24 which seal the re-closing means to the film 4. The means 5, 24 are provided in parallel and each comprise a seal jaw 14, 15, which heat the film and/or the re-closing means. Each sealing comprises two segments through which the film and/or the reclosing means pass. Downstream from the sealing jaws 14, 15, pressing means 16, 17 are provided to press the film ends and/or the film ends and the reclosing means together so that they form a material bond. As can be particularly seen from FIG. 4, the pressing means 17 for the longitudinal seal is provided as a pair of rollers, wherein one roller is provided on one side of the two film ends, respectively. The axis of rotation of the rollers is perpendicular to the transportation direction 13 of the film, which passes through the pair of rollers. The pressing force is preferably adjustable. The pressing means 16 for the reclosing means is preferably provided as a pair of two rollers 16, which are spaced apart, so that the male part of the reclosing means 12 fits in between the two rollers on one axis. The axis of rotation of the rollers 17 is perpendicular to the transportation direction 13 of the film, which passes together with the re-closing means through the pair of rollers 16. The pressing force is preferably adjustable. As can be particularly seen from FIG. 3, upstream from the sealing means for the longitudinal seal, guiding means 19 for the two ends of the film which are sealed together, is provided. The guiding means 19 are here a pair of rollers, one roller being provided on one side of the two ends of the film, whose transport direction is indicated by arrow 21. Each surface of each of the rollers is in touch with the surface of one end of the film. The axis of rotation of each roller is not perpendicular to the transport direction 21 of the film. This stretches the film perpendicular to the transportation direction 21, as indicated by arrow 27 in FIG. 2. As can be seen from FIG. 5, the angle and which the rollers 19 are provided can be adjusted, for example by rotating them around axis 22. This influences the stretching of the film and/or the slip of the film relative to rollers 19. The slip can also, separately or additionally, be influenced by the normal force that the rollers 19 apply to the film. Upstream from the re-closing means sealing means 24 preferably no guiding means is provided.

The gap between the two parts of each sealing means 5, 24 can be adjusted, preferably automatically by means 20. They can move the sealing means 5, 24 together from a remote position to an operation position. Furthermore, the gap between the two jaws of the sealing means 5 and the sealing means 24 can be adjusted individually. This is preferably done manually.

Referring to FIG. 3, downstream from the sealing means 5, 24, preferably stretching means 28 are provided. The stretching means 28 are here a pair of rollers, one roller being provided on one side of the two ends of the film, whose transport direction is indicated by arrow 21. Each surface of each of the rollers is in touch with the surface of one end of the film. The axis of rotation of each roller is not perpendicular to the transport direction 21 of the film. This stretches the film perpendicular to the transportation direction 21, as indicated by arrow 27 in FIG. 2. Preferably, one or both of the rollers are driven, preferably by motor. The rollers 28 are not perpendicular to the transportation direction, but provided at an angle, which can preferably be adjusted, for example by rotating them around an axis. This influences the stretching of the film and/or the slip of the film relative to rollers 28. The slip can also be influenced by the normal force that the rollers 28 apply to the film.

Figure 6A:
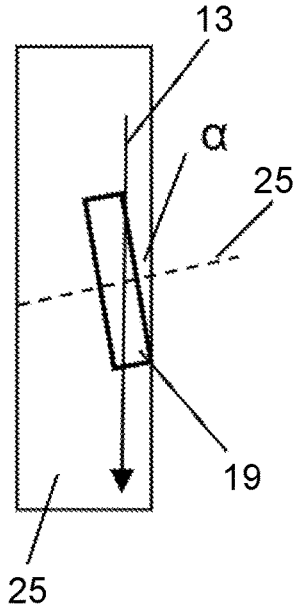
FIGS. 6A and 6B show details of the guiding rollers 19 and/or the stretch rollers 28.
Figure 6B:
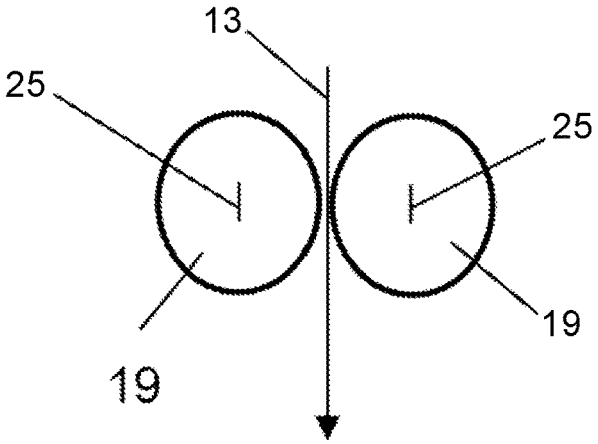
Figure 7:
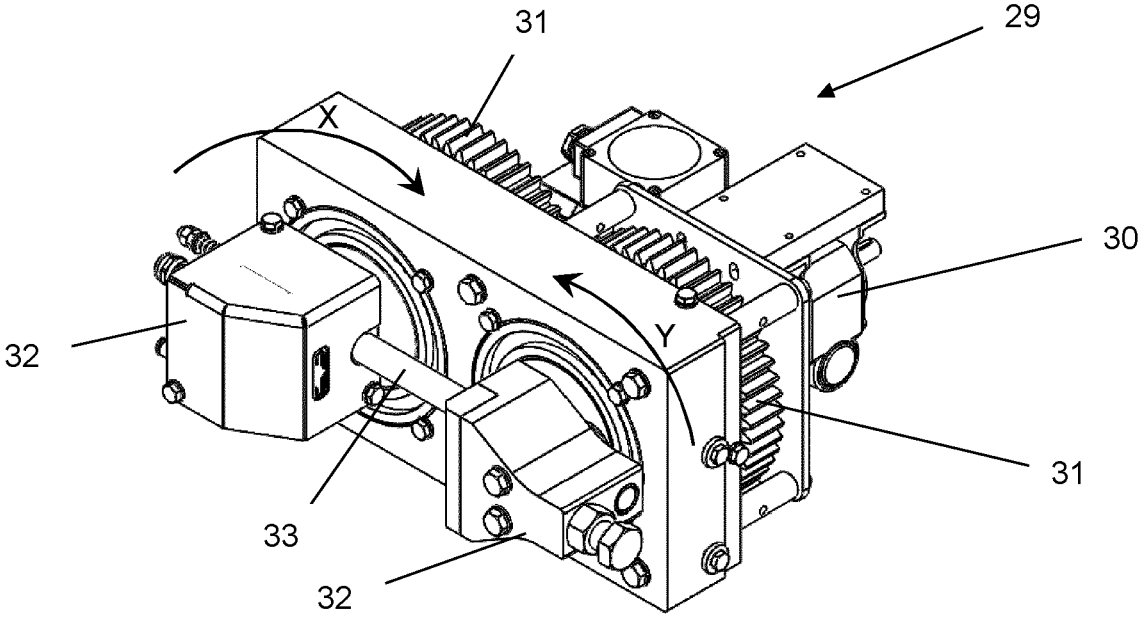
FIG. 7 shows the Eurohole unit wherein the left excentre is in the 9 o'clock position.
Figure 8:
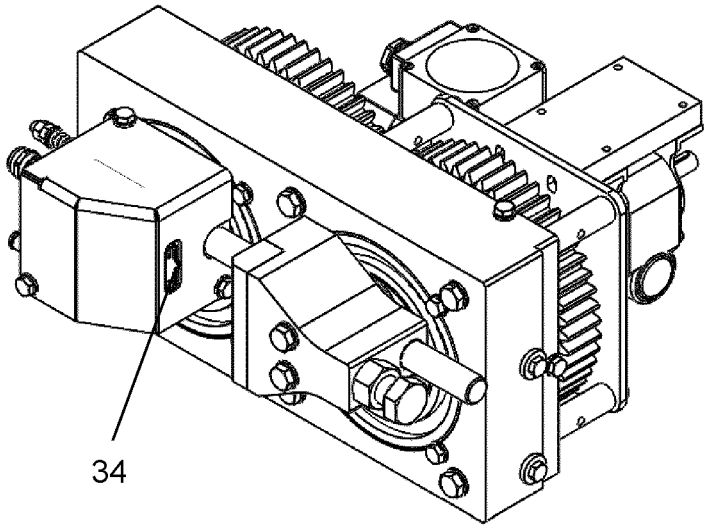
FIG. 8 shows the Eurohole unit wherein the left excentre is in the 12 o'clock position.
Figure 9:
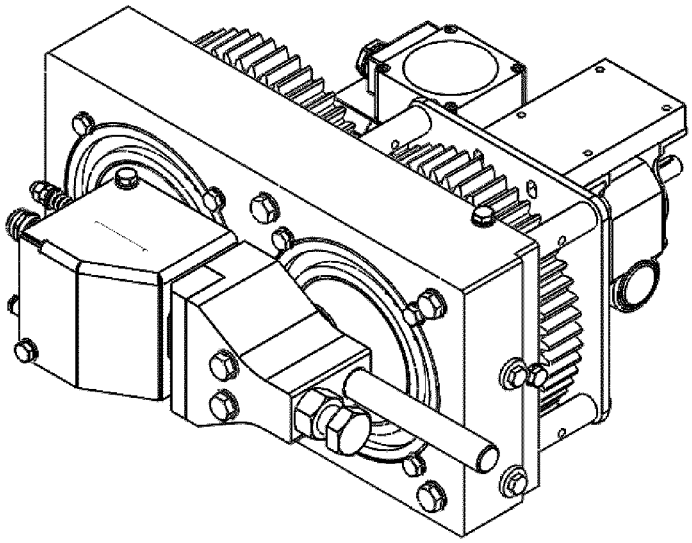
FIG. 9 shows the Eurohole unit wherein the left excentre is in the 3 o'clock position.
Figure 10:
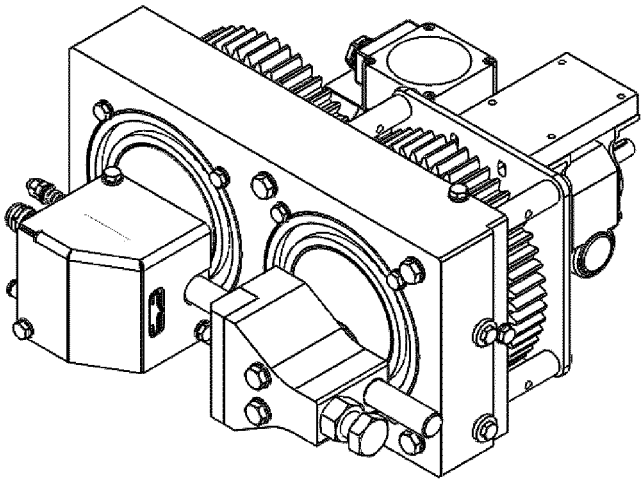
FIG. 10 shows the Eurohole unit wherein the left excentre is in the 6 o'clock position.
Figure 11:
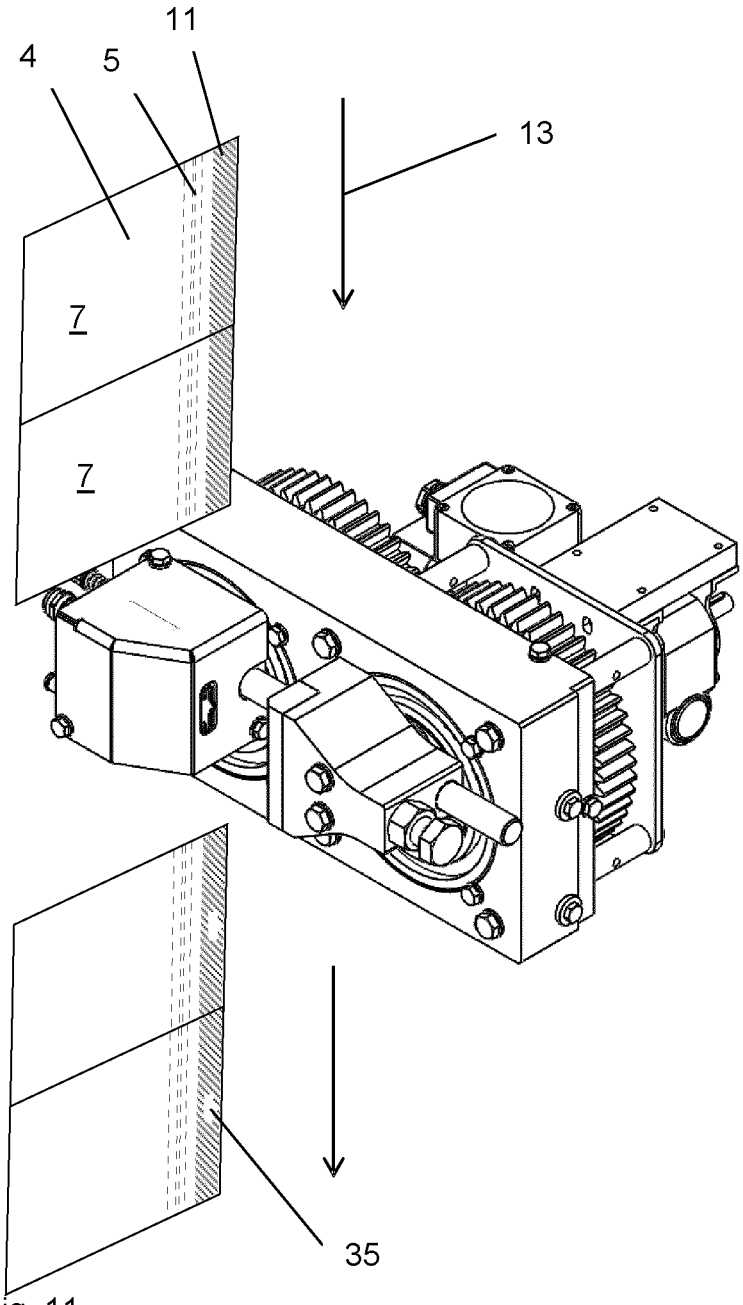
FIG. 11 shows the Eurohole unit in the middle of the cutting position with uncut and cut bags.

FIGS. 6A and 6B show details of the guiding rollers 19. The same applies to the stretching rollers 28. The rollers 19 are provided on each side of one end 26 of the film 4 whose transport direction is indicated by arrow 13. The surface of each roller touches the surface of one end 26 of the film. The axis of rotation 25 of the rollers 19 are not perpendicular to the transport direction 13 of the film. They are provided at an angle $\alpha$ which is $\neq 90°$.

FIGS. 7-12 depict a device 29 for applying a eurohole or the like (in the following "eurohole") to a package, preferably a bag, more preferably a bag produced by a vertical flow-wrapper. The device 29 is provided at the vertical flow wrapper, preferably downstream from the longitudinal sealing means 5. The device applies the eurohole while the film is moving.

The device comprises a motor, which rotates one of the two sprockets 31, which counterrotate as depicted by the arrows with the reference signs X, Y. Connected to each sprocket is an eccentric 32. The skilled person understands that different means than sprockets can be used as counter-rotating means. The eccentrics can be connected via connection means 33, here a rod. The rod 33 can be fixedly connected to one eccentric and guided in a recess of the other eccentric, as a floating bearing. At least one eccentric comprises a punch or a knife 34 to provide the eurohole in the film of a bag. The opposite eccentric may comprise an anvil and/or a counter-knife for the punch/knife 34.

The punch/knife, the anvil/counter-knife are preferably kept in the same orientation, preferably parallel to each other, at least while the cutting process takes place. The punch/knife and/or the counter-knive/anvil can move in a direction with a perpendicular component to the direction of movement 13 of the film tube 4 or bag 7.

Figure 12:
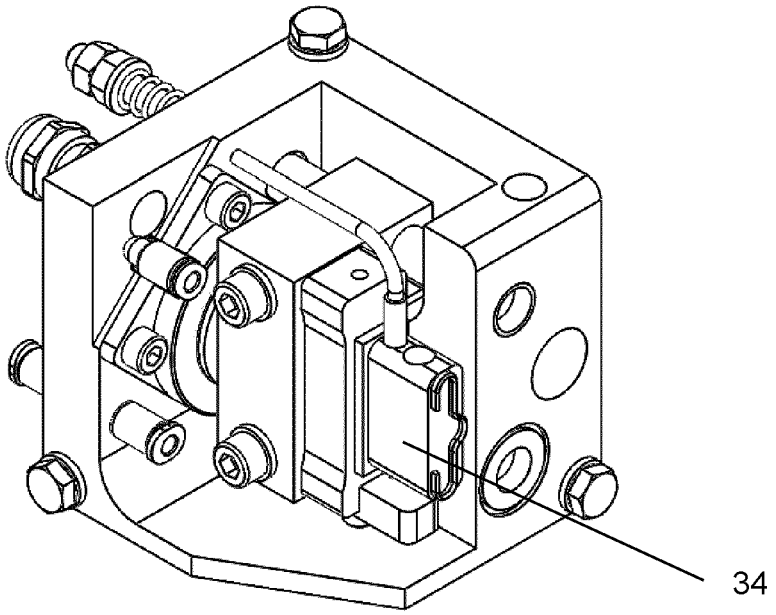
FIG. 12 shows the Eurohole cutting knife with pneumatic cylinder.

The following describes an example of the possible movement of the two eccentrics 32:

When the left eccentrics is in a position between 12 o'clock and 3 o'clock the right eccentrics will be in a position between 12 o'clock and 9 o'clock and the punch/knife 34 and the counter-knife/anvil will cut the film to create a eurohole. The force for the cutting can be provided with a pneumatic cylinder as shown in FIG. 12. The force can also be provided with a spring or an actuator.

The motor 30 is preferable a servomotor but also other motors or a mechanical connection to the main machine can be used.

The eurohole is preferably provided into the longitudinal seal 11 of the bag. The film 4 is moving while the eurohole is punched.

The bag may comprise reclosing means 5.

LIST OF REFERENCE SIGNS

1 vertical flow-wrapper
2 form-fill tube
3 form shoulder
4 film
5 longitudinal-sealing means
6 cross-sealing- and/or cutting means
7 package
8 frame/housing
9 reel
10 cross seal
11 longitudinal seal
12 reclosing means, zipper
13 transport direction of the film and/or package
14 seal jaw longitudinal seal
15 seal jaw reclosing means, seal jaw zipper
16 pressing means for sealing the reclosing means
17 pressing means for providing the longitudinal seal
18 bottom
19 upstream guiding means, guiding rollers
20 displacement drive, linear drive
21 transport direction of the film
22 angle adjustment axis
23 base, base plate
24 reclosing means sealing means
25 axis of rotation of the roller 19
26 transportation plane of the opposite ends of film 4
27 transversal direction
28 stretch rollers, adjustable stretch rollers
29 Device for applying a eurohole
30 motor
31 sprocket
32 eccentric
33 connection means between the eccentrics
34 knife
35 eurohole
X, Y rotation direction

The invention claimed is:

1. A vertical flow-wrapper comprising:

a form-fill-tube along which a film is transported in a transport direction and formed into a film tube, a longitudinal-sealing means, which seals two opposing longitudinal ends of the film tube together to form a longitudinal seal, the longitudinal-sealing means comprising a seal jaw and a pair of guiding rollers provided entirely upstream from the seal jaw to guide the two opposing longitudinal ends of the film tube through the seal jaw and pressing means to press the two opposing longitudinal ends of the film tube together to form the longitudinal seal, wherein the pair of guiding rollers are not driven by a motor, a cross-sealing means and a cutting means which provide cross seals to each package and separate packages from each other, and wherein an axis of rotation of the pair of guiding rollers are provided parallel to a transportation plane of the two opposing longitudinal ends of the film tube and not perpendicular to the transport direction.

2. The vertical flow-wrapper according to claim 1, wherein the pair of guiding rollers stretch the film in a transversal direction.

3. The vertical flow-wrapper according to claim 1, wherein the vertical flow-wrapper comprises a reclosing means sealing means to fix a reclosing means at the film parallel to the longitudinal seal.

4. The vertical flow-wrapper according to claim 3, wherein the reclosing means sealing means comprises a pressing means and/or a seal jaw.

5. The vertical flow-wrapper according to claim 4, wherein the pressing means is two pairs of rollers, each pair provided on one axis.

6. The vertical flow-wrapper according to claim 4, wherein the pressing means are independently adjustable from each other.

7. The vertical flow-wrapper according to claim 3, wherein the seal jaw for the longitudinal seal and/or the seal jaw for the reclosing means sealing means comprises a ceramic strip.

8. The vertical flow-wrapper according to claim 3, wherein the seal jaw for the longitudinal seal and/or the seal jaw for the reclosing means sealing means comprises air ejection means.

9. The vertical flow-wrapper according to claim 1, wherein the longitudinal-sealing means comprises a pressing means and/or a pair of rollers.

10. The vertical flow-wrapper according to claim 1, wherein the vertical flow-wrapper comprises a pair of rollers, downstream from the longitudinal-sealing means, whose axis of rotation are provided parallel to the transportation plane of the two opposing longitudinal ends of the film tube and not perpendicular to the transport direction.

11. The vertical flow-wrapper according to claim 10, wherein at least one roller of the pair of rollers is driven, or is driven by a motor.

12. The vertical flow-wrapper according to claim 10, wherein at least one of the pair or rollers comprises a cylindrical roller and a convex surface.

13. The vertical flow-wrapper according to claim 1, wherein the vertical flow-wrapper comprises a device for applying a hole into the film.

14. A method to produce a bag, the method comprising:
forming a plane film into a tube,
applying a longitudinal seal, with sealing means comprising upstream guiding means to the tube,
applying a lower cross seal to the tube to form the bag,
filling the bag with a packaging item,
applying an upper cross seal to the bag,
wherein the film is guided by two rollers whose axis of rotation are provided parallel to a transportation plane of two opposing ends of the tube and not perpendicular to the tube, the two rollers are arranged entirely upstream of the sealing means.

15. The method according to claim 14, wherein prior and/or after the applying the longitudinal seal step, the opposing ends of the tube are stretched in a direction perpendicular to the transport direction of the tube by two rollers whose axis of rotation are provided parallel to the transportation plane of the two opposing ends of the tube and not perpendicular to the transport direction.

16. The method according to claim 14, wherein an angle of the axis of rotation is adjustable.

* * * * *